US008492064B2

(12) United States Patent
Jugle et al.

(10) Patent No.: US 8,492,064 B2
(45) **Date of Patent: *Jul. 23, 2013**

(54) MAGNETIC TONER COMPOSITIONS

(75) Inventors: Kip L. Jugle, Bloomfield, NY (US); James Winters, Alfred Station, NY (US)

(73) Assignee: Xerox Corporation, Norwalk, CT (US)

( * ) Notice: Subject to any disclaimer, the term of this patent is extended or adjusted under 35 U.S.C. 154(b) by 58 days.

This patent is subject to a terminal disclaimer.

(21) Appl. No.: 12/914,159

(22) Filed: Oct. 28, 2010

(65) Prior Publication Data

US 2012/0107740 A1 May 3, 2012

(51) Int. Cl.
*G03G 9/083* (2006.01)

(52) U.S. Cl.
USPC ..... 430/137.11; 430/137.14

(58) Field of Classification Search
USPC ..... 430/137.14, 137.11
See application file for complete search history.

(56) References Cited

U.S. PATENT DOCUMENTS

| | | | | |
|---|---|---|---|---|
| 3,590,000 | A | 6/1971 | Palermiti et al. | |
| 3,847,604 | A | 11/1974 | Hagenbach et al. | |
| 4,295,990 | A | 10/1981 | Verbeek et al. | |
| 4,797,339 | A | 1/1989 | Maruyama et al. | |
| 4,935,326 | A | 6/1990 | Creatura et al. | |
| 4,937,166 | A | 6/1990 | Creatura et al. | |
| 4,983,488 | A | 1/1991 | Tan et al. | |
| 4,996,127 | A | 2/1991 | Hasegawa et al. | |
| 5,236,629 | A | 8/1993 | Mahabadi et al. | |
| 5,290,654 | A | 3/1994 | Sacripante et al. | |
| 5,302,486 | A | 4/1994 | Patel et al. | |
| 5,330,874 | A | 7/1994 | Mahabadi et al. | |
| 5,346,797 | A | 9/1994 | Kmiecik-Lawrynowicz et al. | |
| 5,364,729 | A | 11/1994 | Kmiecik-Lawrynowicz et al. | |
| 5,403,693 | A | 4/1995 | Patel et al. | |
| 5,418,108 | A | 5/1995 | Kmiecik-Lawrynowicz et al. | |
| 5,501,935 | A | 3/1996 | Patel et al. | |
| 5,527,658 | A | 6/1996 | Hopper et al. | |
| 5,585,215 | A | 12/1996 | Ong et al. | |
| 5,650,255 | A | 7/1997 | Ng et al. | |
| 5,650,256 | A | 7/1997 | Veregin et al. | |
| 5,750,302 | A * | 5/1998 | Ogawa et al. | 430/106.2 |
| 5,853,943 | A | 12/1998 | Cheng et al. | |
| 6,063,827 | A | 5/2000 | Sacripante et al. | |
| 6,194,117 | B1 * | 2/2001 | Smith et al. | 430/137.17 |
| 6,214,507 | B1 | 4/2001 | Sokol et al. | |
| 6,531,256 | B1 * | 3/2003 | Bedells et al. | 430/137.14 |
| 6,593,049 | B1 | 7/2003 | Veregin et al. | |
| 6,617,092 | B1 | 9/2003 | Patel et al. | |
| 6,656,658 | B2 | 12/2003 | Patel et al. | |
| 6,677,092 | B2 | 1/2004 | Arai | |
| 6,756,176 | B2 | 6/2004 | Stegamat et al. | |
| 6,830,860 | B2 | 12/2004 | Sacripante et al. | |
| 7,214,463 | B2 | 5/2007 | Patel et al. | |
| 7,282,314 | B2 | 10/2007 | Patel et al. | |
| 7,329,476 | B2 | 2/2008 | Sacripante et al. | |
| 7,452,646 | B2 | 11/2008 | Hu et al. | |
| 2006/0216626 | A1 | 9/2006 | Sacripante et al. | |
| 2007/0148576 | A1 * | 6/2007 | Ishiyama et al. | 430/106.1 |
| 2008/0107990 | A1 | 5/2008 | Field et al. | |
| 2008/0199797 | A1 * | 8/2008 | Sacripante et al. | 430/104 |
| 2008/0236446 | A1 | 10/2008 | Zhou et al. | |
| 2009/0047593 | A1 | 2/2009 | Vanbesien et al. | |
| 2009/0246679 | A1 * | 10/2009 | Nosella et al. | 430/137.14 |
| 2009/0325098 | A1 * | 12/2009 | Veregin et al. | 430/108.3 |
| 2012/0070770 | A1 * | 3/2012 | Zhou et al. | 430/106.3 |

* cited by examiner

*Primary Examiner* — Janis L Dote
(74) *Attorney, Agent, or Firm* — MDIP LLC

(57) ABSTRACT

The present disclosure relates to a process for preparing a polyester based magnetic toner composition. The toner composition includes one or more polyester amorphous binder resins, optionally a cystalline polyester resin, and spherical ferromagnetic particles. In embodiments, the toner is prepared from ferromagentic particles that have been previously encapsulated in an amorphous resin, a crystalline resin or a wax. In yet other embodiments, the process may be conducted under an inert gas such as argon to avoid oxidation of the ferromagnetic particles during toner preparation.

14 Claims, No Drawings

MAGNETIC TONER COMPOSITIONS

BACKGROUND

The present disclosure relates to toners including magnetic compositions for printing.

Numerous processes are within the purview of those skilled in the art for the preparation of toners. Emulsion aggregation (EA) is one such method. These toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. Other examples of emulsion/aggregation/coalescing processes for the preparation of toners are illustrated in U.S. Pat. Nos. 5,403,693, 5,418,108, 5,364,729, and 5,346,797, the disclosures of each of which are hereby incorporated by reference in their entirety. Other processes are disclosed in U.S. Pat. Nos. 5,527,658, 5,585,215, 5,650,255, 5,650,256 and 5,501,935, the disclosures of each of which are hereby incorporated by reference in their entirety.

Magnetic printing methods employ inks or toners containing magnetic particles. Various magnetic inks and toners have been used in printing digits, characters, or artistic designs, on checks, bank notes and/or currency. The magnetic inks used for these processes may contain, for example, magnetic particles, such as magnetite in a fluid medium, and/or a magnetic coating of ferric oxide, chromium dioxide, or similar materials dispersed in a vehicle including binders and plasticizers.

Toners for Magnetic Ink Character Recognition ("MICR") applications require a minimum magnetic remanence and retentivity to enable check reader/sorters to read the magnetically encoded text. Renanence is synonymous with retentivity and is a measure of the magnetism remaining when the magnetic particle is removed from the magnetic field, i.e., the residual magnetism. When characters printed using an ink or toner having a sufficiently high retentivity are read, the magnetic particles produce a measurable signal that can vary in proportion to the amount of material deposited on the document being generated.

Thus, a magnetic material may be added to the toner. Magnetite (iron oxide) is often used, with an acicular crystal shape. For example, U.S. Pat. Nos. 6,617,092 and 7,282,314, the entire disclosures of each of which are incorporated by reference herein, describe the use of these magnetites in the formation of MICR toners. Acicular magnetites are often 0.1×0.6 microns along the minor and major axis in size. Due to the large size of the long dimension of these particles, along with the high density of the magnetite, these particles are difficult to disperse and stabilize, and also difficult to incorporate into toner, especially in an emulsion/aggregation toner process. Thus, high levels of these magnetites may be required, which may cause difficulties in the aggregation and coalescence of an EA toner.

The magnetic material used for manufacturing such toners is highly reactive and unstable in raw form. More specifically, exposure to air may produce an exothermic reaction resulting in fires. Extra packaging requirements may thus be necessary for shipping magnetite. For example, in some cases, the size of the package may be limited or reduced. The instability of the magnetite may also prevent the materials from being transported by air, or other similar means, which require lengthy delivery times to production facilities. In addition to safety issues, the reactivity also adversely impacts magnetic properties of the material.

It would be advantageous to provide magnetic materials for forming magnetic inks and toners that provide a number of advantages, including, for example, advantageous processing of the materials, including safeguarding the magnetic materials to prevent unintended degradation thereof.

SUMMARY

The present disclosure provides processes for producing ferromagnetic particles suitable for use in forming toner compositions. In embodiments, a process of the present disclosure includes contacting a plurality of ferromagnetic particles with at least one coating agent selected from the group consisting of an amorphous resin, a crystalline resin, a wax, and combinations thereof, to form a plurality of encapsulated ferromagnetic particles; contacting at least one amorphous resin with an optional crystalline resin and the plurality of encapsulated ferromagnetic particles to form a mixture; aggregating the mixture at a pH from about 7 to about 9 to form particles; adjusting the pH of the mixture to from about 7 to about 12 to stop growth of the particles; coalescing the particles at a pH from about 8 to about 12 to form toner particles; and recovering the toner particles.

In other embodiments, a process of the present disclosure includes contacting a plurality of ferromagnetic particles with at least one encapsulating resin selected from the group consisting of amorphous resins, crystalline resins and combinations thereof to form a plurality of encapsulated ferromagnetic particles; contacting at least one amorphous resin with an optional crystalline resin and the encapsulated ferromagnetic particles to form a mixture; aggregating the mixture at a pH from about 7 to about 9 to form particles; adjusting the pH o the mixture to from about 8 to about 12 to stop growth of the particles; coalescing the particles at a pH from about 8 to about 12 to form toner particles; and recovering the toner particles.

In yet other embodiments, a process of the present disclosure includes contacting a plurality of ferromagnetic particles with at least one wax to form a plurality of encapsulated ferromagnetic particles; contacting at least one amorphous resin with at least one crystalline resin and the plurality of encapsulated ferromagnetic particles to form a mixture; aggregating the mixture at a pH from about 7 to about 9 to form particles; adjusting the pH of the mixture to from about 7 to about 12 to stop growth of the particles; coalescing the particles at a pH from about 8 to about 12 to form toner particles; and recovering the toner particles.

DETAILED DESCRIPTION

The present disclosure provides ferromagnetic particles (e.g., magnetite) that may be combined with a toner component such as a resin suitable for forming a toner or an additive such as a wax. The resin or wax are used to encapsulate the ferromagnetic particles and prevent degradation that may occur upon exposure to the environment.

The encapsulated ferromagnetic particles may then be used to form a polyester based EA MICR toner composition including one or more polyester amorphous binder resins, optionally a cystalline polyester resin, and ferromagnetic particles.

The present disclosure also provides a process for preparing polyester based EA MICR toners containing ferromagnetic particles. In embodiments, the aggregation of the toner is conducted at a pH from about 7 to about 9, without the use of a coagulant. Additionally, in embodiments, freezing (stopping particle growth) may be accomplished by adjusting the pH to from about 7 to about 12 and coalescence of the toner particles may be conducted at a pH from about 8 to about 12. In yet other embodiments, the E/A process is conducted under an inert gas such as argon, nitrogen, carbon dioxide and mixtures thereof, to avoid oxidation of the ferromagnetic particles during toner preparation.

In other embodiments, other components could be used to isolate the magnetite from reaction. Such materials should be either inert with respect to the performance of the end product, in embodiments toner, or can be removed using subsequent processing. For example, in embodiments, a toner could be produced using conventional melt mixing techniques. In such a case, the magnetite could be dispersed in palletized dry ice and added to the melt mixer. As the dry ice phase changes in the melt mix, it could be removed from the mixer in the form of $CO_2$ from vacuum ports.

Such melt mixing techniques include, for example, conventional processes wherein a resin is melt kneaded or extruded with a pigment, micronized, and pulverized to provide toner particles. There are illustrated in U.S. Pat. Nos. 5,364,729 and 5,403,693, the disclosures of each of which are hereby incorporated by reference in their entirety, methods of preparing toner particles by blending together latexes with pigment particles. Also relevant are U.S. Pat. Nos. 4,996,127, 4,797,339 and 4,983,488, the disclosures of each of which are hereby incorporated by reference in their entirety.

In embodiments, a dispersion including the encapsulated ferromagnetic particles herein becomes readily incorporated into the toner formulation including the coated material (e.g., resin or wax) without affecting particle morphology.

Resins

Coating materials for encapsulating the ferromagnetic particles, as well as for use in forming the toners of the present disclosure, may include any latex resin suitable for use in forming a toner. Such resins, in turn, may be made of any suitable monomer. Suitable monomers useful in forming the resin include, but are not limited to, acrylonitriles, diols, diacids, diamines, diesters, diisocyanates, combinations thereof, and the like. Any monomer employed may be selected depending upon the particular polymer to be utilized.

The resins may be made by any suitable polymerization method. In embodiments, the resin may be prepared by emulsion polymerization. In other embodiments, the resin may be prepared by condensation polymerization.

In embodiments, the polymer utilized to form the resin may be a polyester resin. Suitable polyester resins include, for example, sulfonated, non-sulfonated, crystalline, amorphous, combinations thereof, and the like. The polyester resins may be linear, branched, combinations thereof, and the like. Polyester resins may include, in embodiments, those resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

The monomers used in making the selected amorphous polyester resin are not limited, and the monomers utilized may include any one or more of, for example, ethylene, propylene, and the like. Known chain transfer agents, for example dodecanethiol or carbon tetrabromide, can be utilized to control the molecular weight properties of the polyester. Any suitable method for forming the amorphous or crystalline polyester from the monomers may be used without restriction.

In embodiments, a resin utilized in forming a toner may include an amorphous polyester resin. In embodiments, the resin may be a polyester resin formed by reacting a diol with a diacid or diester in the presence of an optional catalyst.

Examples of organic diols selected for the preparation of amorphous resins include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of diacid or diesters selected for the preparation of the amorphous polyester include dicarboxylic acids or diesters selected from the group consisting of terephthalic acid, phthalic acid, isophthalic acid, fumaric acid, maleic acid, itaconic acid, succinic acid, succinic anhydride, dodecylsuccinic acid, dodecylsuccinic anhydride, dodecenylsuccinic acid, dodecenylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, dimethyl dodecenylsuccinate, and mixtures thereof. The organic diacid or diester is selected, for example, from about 45 to about 52 mole percent of the resin.

Examples of suitable polycondensation catalyst for either the amorphous polyester resin include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof; and which catalysts are selected in amounts of, for example, from about 0.01 mole percent to about 5 mole percent based on the starting diacid or diester used to generate the polyester resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include amorphous polyester resins. Exemplary amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), poly(1,2-propylene itaconate), a copoly(propoxylated bisphenol A co-fumarate)-copoly(propoxylated bisphenol A co-terephthalate), a terpoly (propoxylated bisphenol A co-fumarate)-terpoly (propoxylated bisphenol A co-terephthalate)-terpoly-(propoxylated bisphenol A co-dodecylsuccinate), and combinations thereof. In embodiments, the amorphous resin utilized in the core may be linear.

In embodiments, a suitable amorphous resin may include alkoxylated bisphenol A fumarate/terephthalate based polyester and copolyester resins. In embodiments, a suitable amorphous polyester resin may be a copoly(propoxylated bisphenol A co-fumarate)-copoly(propoxylated bisphenol A co-terephthalate) resin having the following formula (I):

(I)

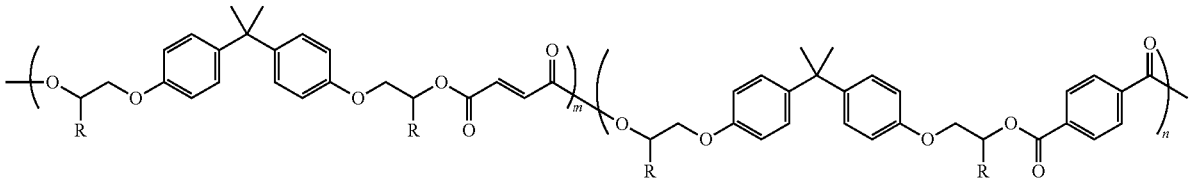

wherein R may be hydrogen or a methyl group, and m and n represent random units of the copolymer and m may be from about 2 to 10, and n may be from about 2 to 10. Examples of such resins and processes for their production include those disclosed in U.S. Pat. No. 6,063,827, the disclosure of which is hereby incorporated by reference in its entirety.

An example of a linear copoly(propoxylated bisphenol A co-fumarate)-copoly(propoxylated bisphenol A co-terephthalate) which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C. and the like.

In embodiments, the amorphous polyester resin may be a saturated or unsaturated amorphous polyester resin. Illustrative examples of saturated and unsaturated amorphous polyester resins selected for the process and particles of the present disclosure include any of the various amorphous polyesters, such as polyethylene-terephthalate, polypropylene-terephthalate, polybutylene-terephthalate, polypentylene-terephthalate, polyhexylene-terephthalate, polyheptadene-terephthalate, polyoctalene-terephthalate, polyethylene-isophthalate, polypropylene-isophthalate, polybutylene-isophthalate, polypentylene-isophthalate, polyhexalene-isophthalate, polyheptadene-isophthalate, polyoctalene-isophthalate, polyethylene-sebacate, polypropylene sebacate, polybutylene-sebacate, polyethylene-adipate, polypropylene-adipate, polybutylene-adipate, polypentylene-adipate, polyhexalene-adipate, polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate polyethylene-pimelate, polypropylene-pimelate, polybutylene-pimelate, polypentylene-pimelate, polyhexalene-pimelate, polyheptadene-pimelate, poly(ethoxylated bisphenol A-fumarate), poly(ethoxylated bisphenol A-succinate), poly(ethoxylated bisphenol A-adipate), poly(ethoxylated bisphenol A-glutarate), poly (ethoxylated bisphenol A-terephthalate), poly(ethoxylated bisphenol A-isophthalate), poly(ethoxylated bisphenol A-dodecenylsuccinate), poly(propoxylated bisphenol A-fumarate), poly(propoxylated bisphenol A-succinate), poly (propoxylated bisphenol A-adipate), poly(propoxylated bisphenol A-glutarate), poly(propoxylated bisphenol A-terephthalate), poly(propoxylated bisphenol A-isophthalate), poly(propoxylated bisphenol A-dodecenylsuccinate), SPAR (Dixie Chemicals), BECKOSOL (Reichhold Inc), ARAKOTE (Ciba-Geigy Corporation), HETRON (Ashland Chemical), PARAPLEX (Rohm & Haas), POLYLITE (Reichhold Inc), PLASTHALL (Rohm & Haas), CYGAL (American Cyanamide), ARMCO (Armco Composites), ARPOL (Ashland Chemical), CELANEX (Celanese Eng), RYNITE (DuPont), STYPOL (Freeman Chemical Corporation) and combinations thereof. The resins can also be functionalized, such as carboxylated, sulfonated, or the like, and particularly such as sodio sulfonated, if desired.

The amorphous polyester resin may be a branched resin. As used herein, the terms "branched" or "branching" includes branched resin and/or cross-linked resins. Branching agents for use in forming these branched resins include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl) methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected is, for example, from about 0.1 to about 5 mole percent of the resin.

Linear or branched unsaturated polyesters selected for reactions include both saturated and unsaturated diacids (or anhydrides) and dihydric alcohols (glycols or diols). The resulting unsaturated polyesters are reactive (for example, crosslinkable) on two fronts: (i) unsaturation sites (double bonds) along the polyester chain, and (ii) functional groups such as carboxyl, hydroxy, and the like groups amenable to acid-base reactions. Typical unsaturated polyester resins may be prepared by melt polycondensation or other polymerization processes using diacids and/or anhydrides and diols.

In embodiments, a suitable amorphous resin utilized in a toner of the present disclosure may be a low molecular weight amorphous resin, sometimes referred to, in embodiments, as an oligomer, having a weight average molecular weight (Mw) of from about 500 daltons to about 10,000 daltons, in embodiments from about 1000 daltons to about 5000 daltons, in other embodiments from about 1500 daltons to about 4000 daltons.

The low molecular weight amorphous resin may possess a glass transition temperature (Tg) of from about 60° C. to about 66° C., in embodiments from about 62° C. to about 64° C. These low molecular weight amorphous resins may be referred to, in embodiments, as a high Tg amorphous resin.

The low molecular weight amorphous resin may possess a softening point of from about 105° C. to about 118° C., in embodiments from about 107° C. to about 109° C.

In other embodiments, an amorphous resin utilized in forming a toner of the present disclosure may be a high molecular weight amorphous resin. As used herein, the high molecular weight amorphous polyester resin may have, for example, a number average molecular weight ($M_n$), as measured by gel permeation chromatography (GPC) of, for example, from about 1,000 to about 10,000, in embodiments from about 2,000 to about 9,000, in embodiments from about 3,000 to about 8,000, and in embodiments from about 6,000 to about 7,000. The weight average molecular weight ($M_w$) of the resin is greater than 45,000, for example, from about 45,000 to about 150,000, in embodiments from about 50,000 to about 100,000, in embodiments from about 63,000 to about 94,000, and in embodiments from about 68,000 to about 85,000, as determined by GPC using polystyrene standard. The polydispersity index (PD) is above about 4, such as, for example, greater than about 4, in embodiments from about 4 to about 20, in embodiments from about 5 to about 10, and in embodiments from about 6 to about 8, as measured by GPC versus standard polystyrene reference resins. The PD index is the ratio of the weight-average molecular weight ($M_w$) and the number-average molecular weight ($M_n$). The low molecular weight amorphous polyester resins may have an acid value of from about 8 to about 20 mg KOH/g, in embodiments from about 9 to about 16 mg KOH/g, and in embodiments from about 11 to about 15 mg KOH/g. The high molecular weight amorphous polyester resins, which are available from a number of sources, can possess various melting points of, for example, from about 30° C. to about 140° C., in embodiments from about 75° C. to about 130° C., in embodiments from about 100° C. to about 125° C., and in embodiments from about 115° C. to about 124° C.

High molecular weight amorphous resins may possess a glass transition temperature of from about 53° C. to about 59° C., in embodiments from about 54.5° C. to about 57° C. These high molecular weight amorphous resins may be referred to, in embodiments, as a low Tg amorphous resin.

In embodiments, a combination of low Tg and high Tg amorphous resins may be used as a coating on a ferromagnetic particle and/or to form a toner of the present disclosure. The ratio of low Tg amorphous resin to high Tg amorphous resin may be from about 0:100 to about 100:0, in embodiments from about 30:70 to about 70:30. In embodiments, the combined amorphous resins may have a melt viscosity of from about 10 to about 1,000,000 Pa*S at about 130° C., in embodiments from about 50 to about 100,000 Pa*S.

The amorphous resin is generally present in the toner composition in various suitable amounts, such as from about 60 to about 90 weight percent, in embodiments from about 50 to about 65 weight percent, of the toner or of the solids.

In embodiments, the toner composition may include at least one crystalline resin. As used herein, "crystalline" refers to a polyester with a three dimensional order. "Semicrystalline resins" as used herein refers to resins with a crystalline percentage of, for example, from about 10 to about 90%, in embodiments from about 12 to about 70%. Further, as used herein, "crystalline polyester resins" and "crystalline resins" encompass both crystalline resins and semicrystalline resins, unless otherwise specified.

In embodiments, the crystalline polyester resin is a saturated crystalline polyester resin or an unsaturated crystalline polyester resin.

For forming a crystalline polyester, suitable organic dials include aliphatic diols having from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof; and the like. The aliphatic diol may be, for example, selected in an amount of from about 40 to about 60 mole percent, in embodiments from about 42 to about 55 mole percent, in embodiments from about 45 to about 53 mole percent of the resin.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, in embodiments from about 40 to about 60 mole percent, in embodiments from about 42 to about 55 mole percent, in embodiments from about 45 to about 53 mole percent.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly (nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and combinations thereof. The crystalline resin may be present, for example, in an amount of from about 5 to about 50 percent by weight of the toner components, in embodiments from about 10 to about 35 percent by weight of the toner components.

The crystalline polyester resins, which are available from a number of sources, may possess various melting points of, for example, from about 30° C. to about 120° C., in embodiments from about 50° C. to about 90° C. The crystalline resins may have, for example, a number average molecular weight ($M_n$), as measured by gel permeation chromatography (GPC) of, for example, from about 1,000 to about 50,000, in embodiments from about 2,000 to about 25,000, in embodiments from about 3,000 to about 15,000, and in embodiments from about 6,000 to about 12,000. The weight average molecular weight ($M_W$) of the resin is 50,000 or less, for example, from about 2,000 to about 50,000, in embodiments from about 3,000 to about 40,000, in embodiments from about 10,000 to about 30,000 and in embodiments from about 21,000 to about 24,000, as determined by GPC using polystyrene standards. The molecular weight distribution ($M_w/M_n$) of the crystalline resin is, for example, from about 2 to about 6, in embodiments from about 3 to about 4. The crystalline polyester resins may have an acid value of about 2 to about 20 mg KOH/g, in embodiments from about 5 to about 15 mg KOH/g, and in embodiments from about 8 to about 13 mg KOH/g. The acid value (or neutralization number) is the mass of potassium hydroxide (KOH) in milligrams that is required to neutralize one gram of the crystalline polyester resin.

Suitable crystalline polyester resins include those disclosed in U.S. Pat. No. 7,329,476 and U.S. Patent Application Publication Nos. 2006/0216626, 2008/0107990, 2008/0236446 and 2009/0047593, each of which is hereby incorporated by reference in their entirety. In embodiments, a suitable crystalline resin may include a resin composed of ethylene glycol or nonanediol and a mixture of dodecanedioic acid and fumaric acid co-monomers with the following formula (II):

(II)

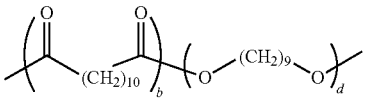

wherein b is from about 5 to about 2000 and d is from about 5 to about 2000.

If semicrystalline polyester resins are employed herein, the semicrystalline resin may include poly(3-methyl-1-butene), poly(hexamethylene carbonate), poly(ethylene-p-carboxy phenoxy-butyrate), poly(ethylene-vinyl acetate), poly(docosyl acrylate), poly(dodecyl acrylate), poly(octadecyl acrylate), poly(octadecyl methacrylate), poly(behenylpolyethoxyethyl methacrylate), poly(ethylene adipate), poly (decamethylene adipate), poly(decamethylene azelaate), poly(hexamethylene oxalate), poly(decamethylene oxalate), poly(ethylene oxide), poly(propylene oxide), poly(butadiene oxide), poly(decamethylene oxide), poly(decamethylene sulfide), poly(decamethylene disulfide), poly(ethylene sebacate), poly(decamethylene sebacate), poly(ethylene suberate), poly(decamethylene succinate), poly(eicosamethylene malonate), poly(ethylene-p-carboxy phenoxy-undecanoate), poly(ethylene dithionesophthalate), poly(methyl ethylene terephthalate), poly(ethylene-p-carboxy phenoxy-valerate), poly(hexamethylene-4,4'-oxydibenzoate), poly(10-hydroxy capric acid), poly(isophthalaldehyde), poly(octamethylene dodecanedioate), poly(dimethyl siloxane), poly(dipropyl siloxane), poly(tetramethylene phenylene diacetate), poly (tetramethylene trithiodicarboxylate), poly(trimethylene dodecane dioate), poly(m-xylene), poly(p-xylylene pimelamide), and combinations thereof.

A crystalline polyester resin as a coating of a ferromagnetic particle and/or for use in a toner particle of the present disclosure may be present in an amount of from about 1 to about 15 percent by weight, in embodiments from about 5 to about 10 percent by weight, and in embodiments from about 6 to about 8 percent by weight, of the toner particles (that is, toner particles exclusive of external additives and water).

As noted above, in embodiments a toner of the present disclosure may also include at least one high molecular weight branched or cross-linked amorphous polyester resin. This high molecular weight resin may include, in embodiments, for example, a branched amorphous resin or amorphous polyester, a cross-linked amorphous resin or amorphous polyester, or mixtures thereof, or a non-cross-linked amorphous polyester resin that has been subjected to cross-linking. In accordance with the present disclosure, from about 1% by weight to about 100% by weight of the high molecular weight amorphous polyester resin may be branched or cross-linked, in embodiments from about 2% by weight to about 50% by weight of the higher molecular weight amorphous polyester resin may be branched or cross-linked.

In embodiments, toner particles of the present disclosure may have a core including from about 0% by weight to about 50% by weight of a low molecular weight, high Tg, amorphous resin, in embodiments from about 10% by weight to about 40% by weight of a low molecular weight, high Tg, amorphous resin, in combination with from about 0% by weight to about 50% by weight of a high molecular weight, low Tg, amorphous resin, in embodiments from about 10% by weight to about 40% by weight of a high molecular weight, low Tg, amorphous resin. Such toner particles may also include a shell including from about 0% by weight to about 35% by weight of a low molecular weight, high Tg, amorphous resin, in embodiments from about 10% by weight to about 25% by weight of a low molecular weight, high Tg, amorphous resin, optionally in combination with from about 0% by weight to about 35% by weight of a high molecular weight, low Tg, amorphous resin, in embodiments from about 10% by weight to about 25% by weight of a high molecular weight, low Tg, amorphous resin.

The ratio of crystalline resin to the amorphous resin can be in the range from about 1:99 to about 40:60, in embodiments from about 3:97 to about 20:80, in embodiments from about 5:95 to about 15:85.

As noted above, in embodiments, the resin may be formed by emulsion aggregation methods. Utilizing such methods, the resin may be present in a resin emulsion, which may then be combined with other components and additives to form a toner of the present disclosure.

Toner

The resin described above may be utilized to form toner compositions. Such toner compositions may include ferromagnetic particles, optional colorants, waxes, and other additives. Toners may be formed utilizing any method within the purview of those skilled in the art.

Colorants

As the optional colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange Oreg. 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax

Optionally, a wax may also be combined with the resin and optional colorant in forming toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Surfactants

In embodiments, colorants, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, available from Rhone-Poulenc as IGEPAL CA210™, IGEPAL CA520™, IGEPAL CA720™, IGEPAL CO-890™, IGEPAL CO720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN RK™, and/or NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Ferromagnetic Particles

In embodiments, it may be desirable to incorporate a ferromagnetic particle into the toner formulation to thus form an MICR toner. Suitable ferromagnetic particles include iron (Fe) nanoparticles, cobalt (Co) nanoparticles, manganese, nickel, barium, Fe/Co alloys, combinations thereof, and the like. Where the ferromagnetic particles are an iron/cobalt alloy, the amount of iron to cobalt may be at a molar ratio of iron to cobalt of from about 30:70 to about 90:10, in embodiments from about 20:80 to about 80:20, in embodiments, from about 50:50 to about 70:30, in further embodiments, about 60:40.

The ferromagnetic particles may, in embodiments, be nanoparticles of a size of from about 1 nm to about 1,000 nm in diameter, in embodiments from about 1 nm to about 200 nm in diameter, in embodiments from about 2 nm to about 100 nm in diameter.

Ferromagnetic particles may be present in a toner of the present disclosure in an amount of from about 2% by weight to about 50% by weight of the toner particles, in embodiments from about 3% by weight to about 30% by weight of the toner particles, in embodiments from about 5% by weight to about 20% by weight of the toner particles.

Coating Ferromagnetic Particles

The ferromagnetic particles according to the present disclosure may be encapsulated in one of the components (e.g., resin) or additives (e.g., wax) used in forming the toner. An encapsulating resin used for encapsulating the ferromagnetic particles may be any of the crystalline or amorphous resins, or combinations thereof, as discussed above. In particular, the ferromagnetic particles may be pre-dispersed in any suitable resin. The pre-dispersion may be formed by melt-mixing of the ferromagnetic particles and the resin to form a coating on the ferromagnetic particles. Other methods for coating the ferromagnetic particle include, for example, solution coating, vapor coating, spray coating, combinations thereof, and the like. The ratio of the resin to the ferromagnetic particles in the pre-dispersion may be from about 40% by weight to about 70% by weight of the ferromagnetic particles, in embodiments from about 50% by weight to about 60% by weight of the ferromagnetic particles.

The resulting ferromagnetic particles may possess a resin coating in an amount of from about 0.1% by weight to about 40% by weight of the ferromagnetic particles, in embodiments from about 1% by weight to about 20% by weight of the ferromagnetic particles.

Suitable waxes for encapsulating the ferromagnetic particles may be any waxes or combinations thereof discussed above. In particular, the ferromagnetic particles may be coated by initially melting the wax and then combining the melted wax with the ferromagnetic particles. Other methods for coating the ferromagnetic particle include, for example, solution coating, vapor coating, spray coating, combinations thereof, and the like. The ratio of the wax to the ferromagnetic particles in the pre-dispersion may be from about 40% by weight to about 70% by weight of the ferromagnetic load, in embodiments from about 50% by weight to about 60% by weight of the ferromagnetic load.

The resulting ferromagnetic particles may possess a wax coating in an amount of from about 0.1% by weight to about 40% by weight of the ferromagnetic particles, in embodiments from about 1% by weight to about 20% by weight of the ferromagnetic particles.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner particle shape and morphology.

In embodiments, toner compositions may be prepared by emulsion-aggregation processes, such as a process that includes aggregating a mixture of an optional colorant, an optional wax and any other desired or required additives, and emulsions including the resins described above, optionally in surfactants as described above, and then coalescing the aggregate mixture. In embodiments, the encapsulated ferromagnetic particles may be combined with other toner components, such as other resins, and other additives, such as colorants, surfactants, etc. Thus, the ratio of the coating material to the ferromagnetic particles may be adjusted during encapsulation of the ferromagnetic particles to obtain a desired amount of the resin and/or the wax so that the resulting toner possess the desired amount of resin and/or wax upon addition of the encapsulated ferromagnetic particles to other toner components and/or additives.

A mixture may be prepared by adding a colorant and optionally a wax or other materials, which may also be optionally in a dispersion(s) including a surfactant, to the emulsion, which may be a mixture of two or more emulsions containing the resin. The pH of the resulting mixture may be adjusted by an acid such as, for example, acetic acid, nitric acid or the like. In embodiments, the pH of the mixture may be adjusted to from about 4 to about 5. Additionally, in embodiments, the mixture may be homogenized. If the mixture is homogenized, homogenization may be accomplished by mixing at about 600 to about 4,000 revolutions per minute.

Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1% to about 8% by weight, in embodiments from about 0.2% to about 5% by weight, in other embodiments from about 0.5% to about 5% by weight, of the resin in the mixture. This provides a sufficient amount of agent for aggregation.

In order to control aggregation and subsequent coalescence of the particles, in embodiments the aggregating agent may be metered into the mixture over time. For example, the agent may be metered into the mixture over a period of from about 5 to about 240 minutes, in embodiments from about 30 to about 200 minutes. The addition of the agent may also be done while the mixture is maintained under stirred conditions, in embodiments from about 50 revolutions per minute (rpm) to about 1,000 rpm, in other embodiments from about 100 rpm to about 500 rpm, and at a temperature that is below the glass transition temperature of the resin as discussed above, in embodiments from about 30° C. to about 90° C., in embodiments from about 35° C. to about 70° C.

In other embodiments, the emulsion aggregation process may occur without the addition of an aggregating agent. In embodiments, the emulsion aggregation process may be conducted under an inert gas such as argon, nitrogen, carbon dioxide, combinations thereof, and the like, to avoid oxidation of the ferromagnetic particles during toner preparation.

The particles may be permitted to aggregate until a predetermined desired particle size is obtained. Such aggregation may occur at a pH of greater than about 4, in embodiments from about 4 to about 10, in embodiments from about 6 to about 10, in embodiments from about 7 to about 9. A predetermined desired size refers to the desired particle size to be obtained as determined prior to formation, and the particle size being monitored during the growth process until such particle size is reached. Samples may be taken during the growth process and analyzed, for example with a COULTER COUNTER, for average particle size. The aggregation thus may proceed by maintaining the elevated temperature, or slowly raising the temperature to, for example, from about 30° C. to about 99° C., and holding the mixture at this temperature for a time from about 0.5 hours to about 10 hours, in embodiments from about hour 1 to about 5 hours, while maintaining stirring, to provide the aggregated particles. Once the predetermined desired particle size is reached, then the growth process is halted. In embodiments, the predetermined desired particle size is within the toner particle size ranges mentioned above.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

Once the desired final size of the toner particles is achieved, the pH of the mixture may be adjusted with a base to a value of from about 6 to about 14, and in embodiments from about 7 to about 12. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above.

Shell Resin

In embodiments, after aggregation, but prior to coalescence, a shell may be applied to the aggregated particles. Resins which may be utilized to form the shell include, but are not limited to, the amorphous resins described above. In embodiments, an amorphous resin which may be used to form a shell in accordance with the present disclosure may include an amorphous polyester of formula I above.

In some embodiments, the amorphous resin utilized to form the shell may be crosslinked. For example, crosslinking may be achieved by combining an amorphous resin with a crosslinker, sometimes referred to herein, in embodiments, as an initiator. Examples of suitable crosslinkers include, but are not limited to, for example free radical or thermal initiators such as organic peroxides and azo compounds described above as suitable for forming a gel. Examples of suitable organic peroxides include diacyl peroxides such as, for example, decanoyl peroxide, lauroyl peroxide and benzoyl peroxide, ketone peroxides such as, for example, cyclohexanone peroxide and methyl ethyl ketone, alkyl peroxyesters such as, for example, t-butyl peroxy neodecanoate, 2,5-dimethyl 2,5-di(2-ethyl hexanoyl peroxy)hexane, t-amyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, oo-t-butyl o-isopropyl mono peroxy carbonate, 2,5-dimethyl 2,5-di(benzoyl peroxy)hexane, oo-t-butyl o-(2-ethyl hexyl)mono peroxy carbonate, and oo-t-amyl o-(2-ethyl hexyl)mono peroxy carbonate, alkyl peroxides such as, for example, dicumyl peroxide, 2,5-dimethyl 2,5-di(t-butyl peroxy)hexane, t-butyl cumyl peroxide, α-α-bis(t-butyl peroxy) diisopropyl benzene, di-t-butyl peroxide and 2,5-dimethyl 2,5di(t-butyl peroxy)hexyne-3, alkyl hydroperoxides such as, for example, 2,5-dihydro peroxy 2,5-dimethyl hexane, cumene hydroperoxide, t-butyl hydroperoxide and t-amyl hydroperoxide, and alkyl peroxyketals such as, for example, n-butyl 4,4-di(t-butyl peroxy)valerate, 1,1-di(t-butyl peroxy) 3,3,5-trimethyl cyclohexane, 1,1-di(t-butyl peroxy)cyclohexane, 1,1-di(t-amyl peroxy)cyclohexane, 2,2-d (t-butyl peroxy)butane, ethyl 3,3-di(t-butyl peroxy)butyrate and ethyl 3,3-di(t-amyl peroxy)butyrate, and combinations thereof. Examples of suitable azo compounds include 2,2,'-azobis(2,4-dimethylpentane nitrile), azobisisobutyronitrile, 2,2'-azobis (isobutyronitrile), 2,2'-azobis (2,4-dimethyl valeronitrile), 2,2'-azobis (methyl butyronitrile), 1,1'-azobis(cyano cyclohexane), other similar known compounds, and combinations thereof.

The crosslinker and amorphous resin may be combined for a sufficient time and at a sufficient temperature to form the crosslinked polyester gel. In embodiments, the crosslinker and amorphous resin may be heated to a temperature of from about 25° C. to about 99° C., in embodiments from about 30° C. to about 95° C., for a period of time of from about 1 minute to about 10 hours, in embodiments from about 5 minutes to about 5 hours, to form a crosslinked polyester resin or polyester gel suitable for use as a shell.

Where utilized, the crosslinker may be present in an amount of from about 0.001% by weight to about 5% by weight of the resin, in embodiments from about 0.01% by weight to about 1% by weight of the resin. The amount of CCA may be reduced in the presence of crosslinker or initiator.

A single polyester resin may be utilized as the shell or, in embodiments, a first polyester resin may be combined with other resins to form a shell. Multiple resins may be utilized in any suitable amounts. In embodiments, a first amorphous polyester resin, for example a high Tg amorphous resin described above, may be present in an amount of from about 0 percent by weight to about 100 percent by weight of the total shell resin, in embodiments from about 20 percent by weight to about 80 percent by weight of the total shell resin. Thus, in embodiments, a second resin, in embodiments a low Tg amorphous resin, may be present in the shell resin in an amount of from about 0 percent by weight to about 100 percent by weight of the total shell resin, in embodiments from about 20 percent by weight to about 80 percent by weight of the shell resin.

Coalescence

Following aggregation to the desired particle size and application of any shell resin as described above, the particles may then be coalesced to the desired final shape, the coalescence being achieved by, for example, heating the mixture to a suitable temperature. This temperature may, in embodiments, be from about 0° C. to about 50° C. higher than the onset melting point of the crystalline polyester resin utilized in the core, in other embodiments from about 5° C. to about 30° C. higher than the onset melting point of the crystalline polyester resin utilized in the core. Higher or lower temperatures may be used, it being understood that the temperature is a function of the resins used.

Coalescence may occur at a pH of about 9 or greater than about 9, in embodiments from about 7 to about 14, in embodiments from about 8 to about 13, in embodiments from about 8 to about 12.

Coalescence may also be carried out with stirring, for example at a speed of from about 50 rpm to about 1,000 rpm, in embodiments from about 100 rpm to about 600 rpm. Coalescence may be accomplished over a period of from about 1 minute to about 24 hours, in embodiments from about 5 minutes to about 10 hours.

After coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

While the above disclosure has described polyester based EA MICR toner compositions in detail, the ferromagnetic particles of the present disclousre may be utilized with any toner within the purview of those skilled in the art. Thus, in addition to the emulsion aggregation toners, as previously described, in embodiments the ferromagnetic particles described herein may be utilized with conventional toners produced by melt-mixing resins, optionally with colorants, and optionally with waxes, forming agglomerated particles, and grinding or similarly treating the agglomerated particles to form toner particles. In other embodiments, the ferromagnetic particles described herein may be utilized with toners produced by chemical synthesis methods, including toners produced in suspensions, by chemical milling, combinations thereof, and the like.

Additives

In embodiments, the toner particles may also contain other optional additives, as desired or required. For example, there can be blended with the toner particles external additive particles including charge control agents (CCAs), flow aid additives, combinations thereof, and the like, which additives may be present on the surface of the toner particles. Examples of these additives include metal oxides such as titanium oxide, silicon oxide, tin oxide, mixtures thereof, and the like; colloidal and amorphous silicas, such as AEROSIL®, metal salts and metal salts of fatty acids inclusive of zinc stearate, aluminum oxides, cerium oxides, and mixtures thereof. Each of these external additives may be present in an amount of from about 0.1 percent by weight to about 5 percent by weight of the toner, in embodiments of from about 0.25 percent by weight to about 3 percent by weight of the toner. Suitable additives include those disclosed in U.S. Pat. Nos. 3,590,000, 6,214,507, and 7,452,646 the disclosures of each of which are hereby incorporated by reference in their entirety. Again, these additives may be applied simultaneously with the shell resin described above or after application of the shell resin.

In embodiments, toners of the present disclosure may be utilized as ultra low melt (ULM) toners. The addition of the ferromagnetic particles does not adversely affect the morphology of the toner particles. In embodiments, the dry toner particles of the present disclosure may, exclusive of external surface additives, have the following characteristics:

(1) Volume average diameter (also referred to as "volume average particle diameter") of from about 3 to about 25 μm, in embodiments from about 4 to about 15 μm, in other embodiments from about 5 to about 12 μm.

(2) Number Average Geometric Size Distribution (GSDn) and/or Volume Average Geometric Size Distribution (GSDv) of from about 1.05 to about 1.55, in embodiments from about 1.1 to about 1.45.

(3) Circularity of from about 0.93 to about 1, in embodiments from about 0.95 to about 0.99 (measured with, for example, a Sysmex FPIA 2100 analyzer).

The characteristics of the toner particles may be determined by any suitable technique and apparatus. Volume average particle diameter $D_{50v}$, GSDv, and GSDn may be measured by means of a measuring instrument such as a BECKMAN COULTER MULTISIZER 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a BECKMAN COULTER MULTISIZER 3.

Toners produced in accordance with the present disclosure may possess excellent charging characteristics when exposed to extreme relative humidity (RH) conditions. The low-humidity zone (C zone) may be about 10° C./15% RH, while the high humidity zone (A zone) may be about 28° C./85% RH.

Toners of the present disclosure may possess A zone charging of from about −3 μC/g to about −60 μC/g, in embodiments from about −4 μC/g to about −50 μC/g, a parent toner charge per mass ratio (Q/M) of from about −3 μC/g to about −60 μC/g, in embodiments from about −4 μC/g to about −50 μC/g, and a final triboelectric charge of from −4 μC/g to about −50 μC/g, in embodiments from about −5 μC/g to about −40 μC/g.

In accordance with the present disclosure, the charging of the toner particles may be enhanced, so less surface additives may be required, and the final toner charging may thus be higher to meet machine charging requirements.

Developers

The toner particles thus obtained may be formulated into a developer composition. The toner particles may be mixed with carrier particles to achieve a two-component developer composition. The toner concentration in the developer may be from about 1% to about 25% by weight of the total weight of the developer, in embodiments from about 2% to about 15% by weight of the total weight of the developer.

Carriers

Examples of carrier particles that can be utilized for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 weight % to about 70 to about 30 weight %, in embodiments from about 40 to about 60 weight % to about 60 to about 40 weight %. The coating may have a coating weight of, for example, from about 0.1 to about 5% by weight of the carrier, in embodiments from about 0.5 to about 2% by weight of the carrier.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size, coated with about 0.5% to about 10% by weight, in embodiments from about 0.7% to about 5% by weight, of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition. However, different toner and carrier percentages may be used to achieve a developer composition with desired characteristics.

Imaging

The toners can be utilized for electrophotographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with an electrophotographic device including a charging component, an imaging component, a photoconductive component, a developing component, a transfer component, and a fusing component. In embodiments, the development component may include a developer prepared by mixing a carrier with a toner composition described herein. The electrophotographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C., after or during melting onto the image receiving substrate.

In embodiments where the toner resin is crosslinkable, such crosslinking may be accomplished in any suitable manner. For example, the toner resin may be crosslinked during fusing of the toner to the substrate where the toner resin is crosslinkable at the fusing temperature. Crosslinking also may be affected by heating the fused image to a temperature at which the toner resin will be crosslinked, for example in a post-fusing operation. In embodiments, crosslinking may be effected at temperatures of from about 160° C. or less, in embodiments from about 70° C. to about 160° C., in other embodiments from about 80° C. to about 140° C.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A process comprising:

(a) contacting a plurality of ferromagnetic particles with at least one encapsulating resin selected from the group consisting of amorphous resins, crystalline resins, and combinations thereof to form a plurality of encapsulated ferromagnetic particles;

(b) contacting at least one amorphous resin with an optional crystalline resin and the plurality of encapsulated ferromagnetic particles to form a mixture;

(c) aggregating the mixture at a pH from about 7 to about 9 under an inert gas to form particles;

(d) adjusting the pH of the mixture to from about 7 to about 12 to stop growth of the particles;

(e) coalescing the particles at a pH from about 8 to about 12 under an inert gas to form magnetic ink character recognition toner particles; and (f) recovering the magnetic ink character recognition toner particles.

2. The process of claim 1, wherein the plurality of ferromagnetic particles have a diameter of from about 1 nm to about 1,000 nm.

3. The process of claim 1, wherein the plurality of ferromagnetic particles comprise a metal selected from the group consisting of iron, cobalt, nickel, manganese, barium and iron-cobalt alloys.

4. The process of claim 1, wherein the plurality of ferromagnetic particles comprise an iron-cobalt alloy having a molar ratio of iron to cobalt from about 30:70 to about 90:10.

5. The process of claim 1, wherein the at least one amorphous resin of step (b) comprises an alkoxylated bisphenol A fumarate/terephthalate based polyester and copolyester resin and wherein the optional crystalline resin of step (b) comprises (II)

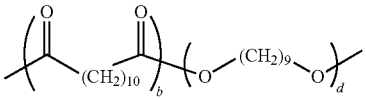

wherein b is from about 5 to about 2000 and d is from about 5 to about 2000.

6. The process of claim 1, wherein the at least one encapsulating resin is present in an amount from about 0.1 percent by weight to about 40 percent by weight of the ferromagnetic particles.

7. A process comprising:

contacting a plurality of ferromagnetic particles with at least one wax to form a plurality of encapsulated ferromagnetic particles;

contacting at least one amorphous resin with at least one crystalline resin and the plurality of encapsulated ferromagnetic particles to form a mixture;

aggregating the mixture at a pH from about 7 to about 9 to form particles;

adjusting the pH of the mixture to from about 7 to about 12 to stop growth of the particles:

coalescing the particles at a pH from about 8 to about 12 to form toner particles, and recovering the toner particles, wherein said plurality of ferromagnetic particles comprise an iron-cobalt alloy having a molar ratio of iron to cobalt from about 30:70 to about 90:10; or said aggregating and said coalescing occur under an inert gas.

8. The process of claim 7, wherein the plurality of ferromagnetic particles have a diameter of from about 1 nm to about 1,000 nm.

9. The process of claim 7, wherein the plurality of ferromagnetic particles comprise an iron-cobalt alloy having a molar ratio of iron to cobalt from about 30:70 to about 90:10.

10. The process of claim 7, wherein aggregating the mixture and coalescing the particles occur under an inert gas.

11. The process of claim 10, wherein the plurality of ferromagnetic particles comprise a metal selected from the group consisting of iron, cobalt, nickel, manganese, barium and iron-cobalt alloys.

12. The process of claim 10, wherein the plurality of ferromagnetic particles comprise an iron-cobalt alloy having a molar ratio of iron to cobalt from about 30:70 to about 90:10.

13. The process of claim 7, wherein the at least one amorphous resin comprises an alkoxylated bisphenol A fumarate/terephthalate based polyester and copolyester resin and wherein the at least one crystalline resin comprises (II)

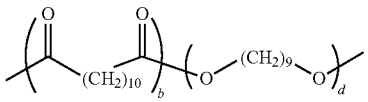

wherein b is from about 5 to about 2000 and d is from about 5 about 2000.

14. The process of claim 7, wherein the at least one wax is present in an amount from about 0.1 percent by weight to about 40 percent b weight of the ferromagnetic particles.

* * * * *